US008298003B2

(12) United States Patent
Wu

(10) Patent No.: US 8,298,003 B2
(45) Date of Patent: Oct. 30, 2012

(54) MULTI-FUNCTIONAL ADAPTATION WINDER

(76) Inventor: Sung-Chiang Wu, New Taipei (TW)

( * ) Notice: Subject to any disclaimer, the term of this patent is extended or adjusted under 35 U.S.C. 154(b) by 0 days.

(21) Appl. No.: 13/077,954

(22) Filed: Mar. 31, 2011

(65) Prior Publication Data

US 2012/0252261 A1 Oct. 4, 2012

(51) Int. Cl.
*H01R 13/72* (2006.01)

(52) U.S. Cl. ..... 439/501; 439/638

(58) Field of Classification Search ..... 439/501, 439/638, 528, 639, 527
See application file for complete search history.

(56) References Cited

U.S. PATENT DOCUMENTS 6,623,294 B2 * 9/2003 Tse et al. ..... 439/501
6,733,328 B2 * 5/2004 Lin et al. ..... 439/501
6,790,062 B1 * 9/2004 Liao ..... 439/171
7,959,444 B2 * 6/2011 Corless et al. ..... 439/4
2009/0298325 A1 * 12/2009 Jonker et al. ..... 439/501
2010/0084236 A1 * 4/2010 Yang ..... 191/12.4
2011/0076880 A1 * 3/2011 Fleisig ..... 439/501
2011/0287665 A1 * 11/2011 Chien ..... 439/638

* cited by examiner

*Primary Examiner* — Gary F. Paumen
(74) *Attorney, Agent, or Firm* — Leong C. Lei

(57) ABSTRACT

A multi-functional adaptation winder is provided, which includes a wiring part, a transmission connector, a tapping part, at least one adapter and a connecting kit. The transmission connector is connected with an outlet wire at one end of the wiring part. The tapping part is provided with at least one connector which is connected with an outlet wire at the other end of the wiring part. The adapter is plugged into the connector of the tapping part and is provided with at least one attaching hole at an external portion thereof. The connecting kit is provided with at least one attaching segment and a spigot. The spigot is connected with the tapping part, and the attaching segment is matched with the attaching hole.

8 Claims, 8 Drawing Sheets

MULTI-FUNCTIONAL ADAPTATION WINDER

BACKGROUND OF THE INVENTION (a) Technical Field of the Invention

The present invention relates to a multi-functional adaptation winder, and more particularly to a multi-functional adaptation winder which is convenient for carrying a multi-interface adapter.

(b) Description of the Prior Art

Nowadays, the digital science technology develops rapidly, and digital products are popular at every place. As for a smart phone taken along with a person on the road, a computer and a 3C product, different transmission interfaces or charging interfaces can be seen everywhere. However, during data transmission and charging, some of these devices usually cannot be connected with a computer USB port, and thus cannot transmit data or be charged through a USB.

Among conventional adaptation products, a common one is a multi-adapter product with two USB connectors or other types of connectors, in which a user can freely choose to demount or mount an interface for desired use. However, since the interface can be demounted, the problem of losing a connector may be easily caused for the product with various connectors. If an adapter is lost, the interface cannot be used any more. From the above, it can be seen that due to the problems and defects derived from the conventional adaption product, the product is not a good design and needs to be improved.

In view of the various problems and defects derived from the manner above, the inventor of the present invention exerts best efforts to improve and innovate on the conventional product. After years of assiduous research, the multi-functional adaptation winder of the present invention is successfully invented.

SUMMARY OF THE INVENTION

The present invention provides a multi-functional adaptation winder, which includes a wiring part, a transmission connector, a tapping part, an adapter and a connecting kit. Outlet wires at two ends of the wiring part are respectively connected with the transmission connector and the tapping part.

The tapping part is plugged with an adapter which is provided with at least one attaching hole at an external portion thereof. Furthermore, the connecting kit is provided with at least one attaching segment and a spigot connected with the tapping part, wherein the attaching segment is matched with the attaching hole for fixing the adapter. Thus, a tap connector is attached to the adapter, so that the adapter will not be lost after being unplugged.

Preferably, the tapping part has two tap connectors which are respectively a MICRO USB connector and a MINI USB connector.

Preferably, the spigot is provided with two attaching segments at opposite sides thereof for attaching two adapters.

The present invention is mainly directed to providing a multi-interface transmission guide line for a user, so as to expand a transmission capability of a mobile portable device and make it convenient for use on various types of charger interfaces, thereby charging the device to increase its using time.

The present invention is also directed to appropriately adjusting a length of the guide line, so that a user can extend a transmission range and enjoy a convenient life.

The present invention is further directed to attaching a commonly-used and required interface connector so that a carrier will not lose the connector.

DETAILED DESCRIPTION OF THE PREFERRED EMBODIMENTS

In order to make it convenient for a patent examiner to know about other features and advantages of the present invention, and in order to make the effects achieved by the present invention more apparent, the present invention will be described in detail hereinafter with reference to the accompanying drawings.

Figure 8:
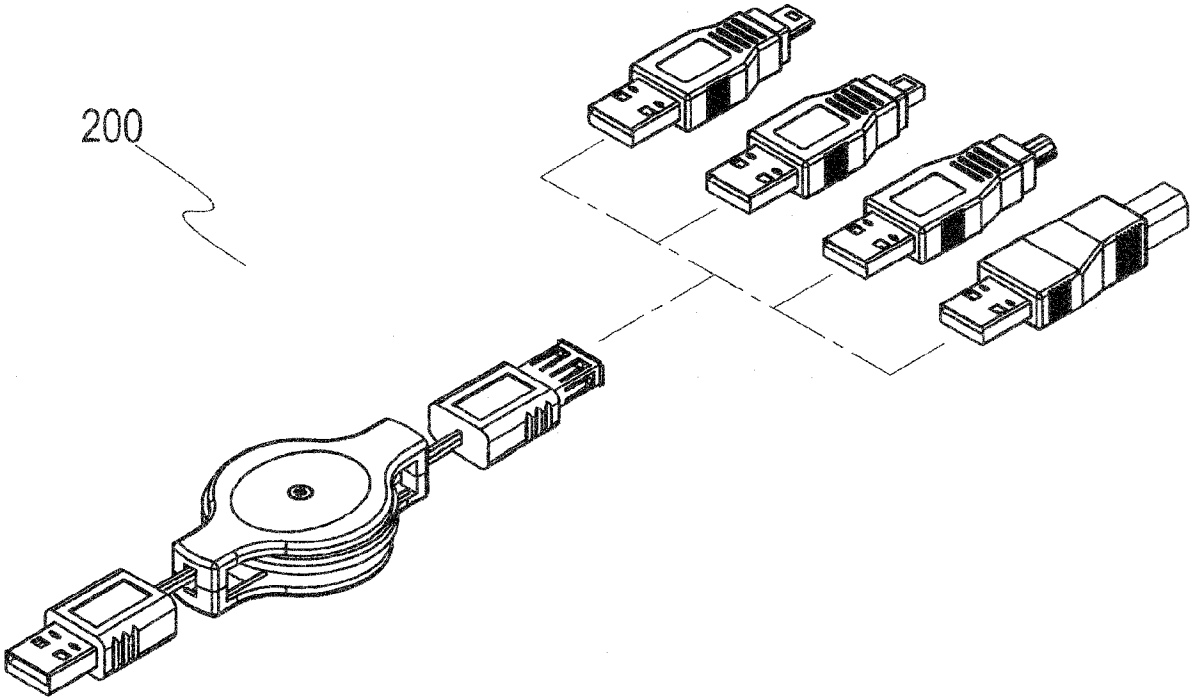
FIG.8 PRIOR ART
FIG. 8 is a schematic view of a conventional adaption product.

Refer to FIG. 8, which is a schematic perspective view of a conventional adaption product 200. Due to various adapters, an interface cannot be used any more if the adapter is lost when carried.

Figure 1:
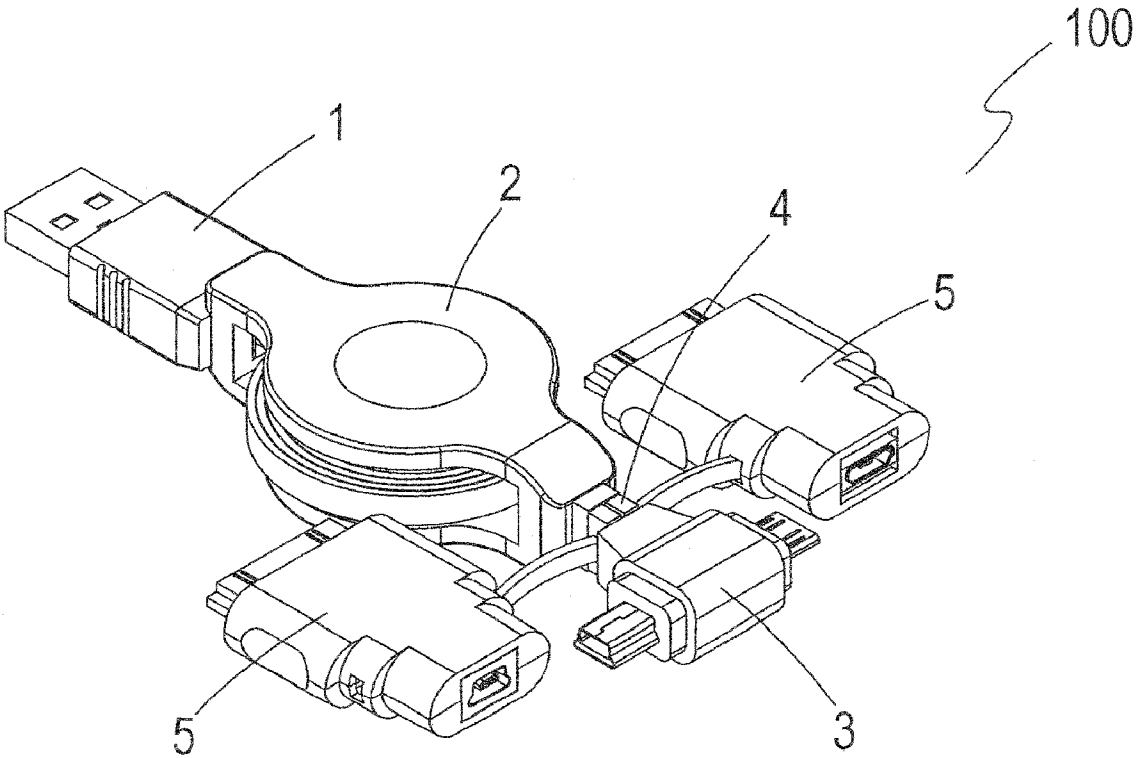
FIG. 1 is a schematic perspective appearance view of the present invention.

Refer to FIG. 1, which is a schematic perspective appearance view of the present invention. As can be seen from the appearance shown in the figure, the present invention includes a wiring part 1, a transmission connector 2, a tapping part 3, a connecting kit 4 and two adapters 5.

Figure 2:
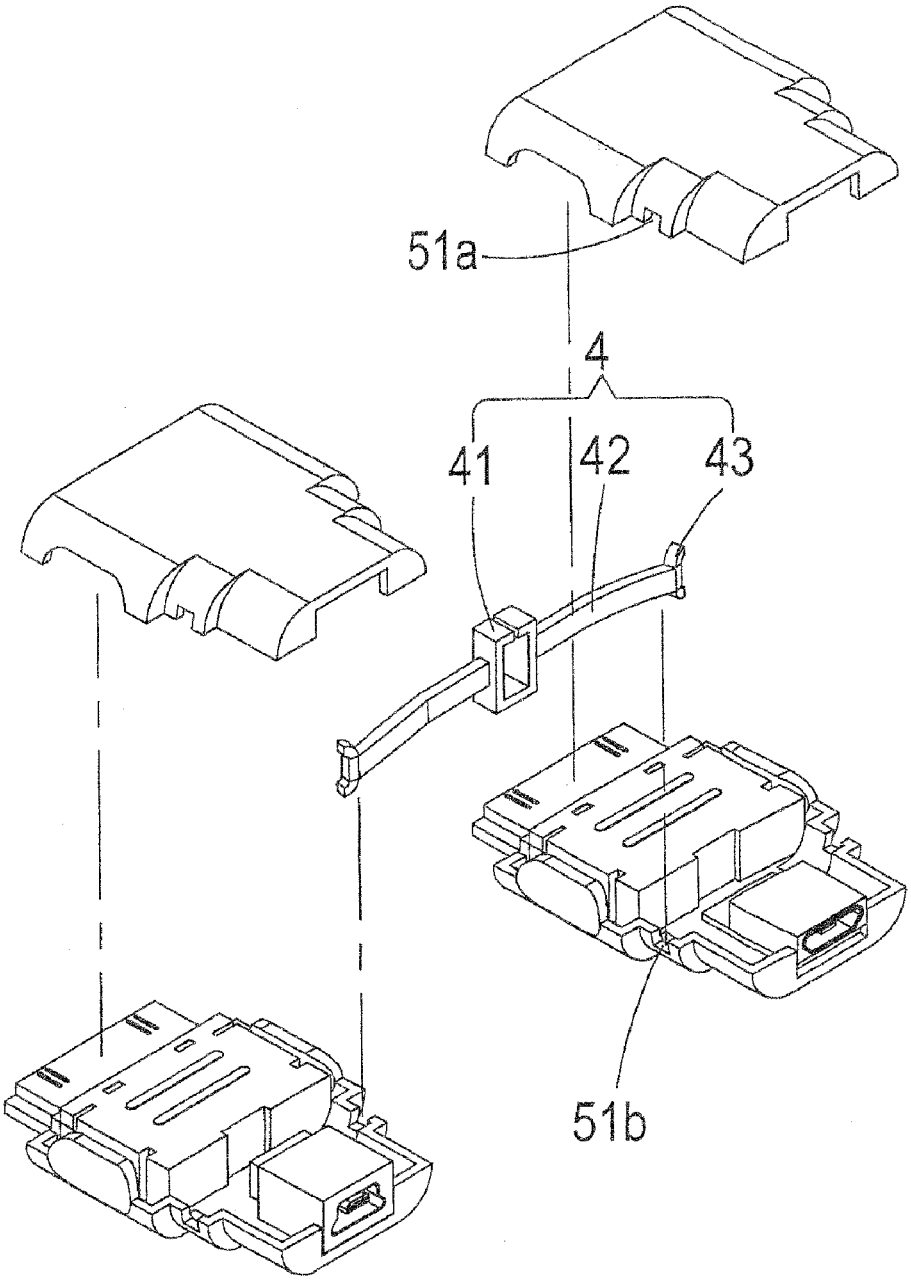
FIG. 2 is a schematic view of a combination relationship between the connecting kit and the adapter of the present invention.
Figure 3:
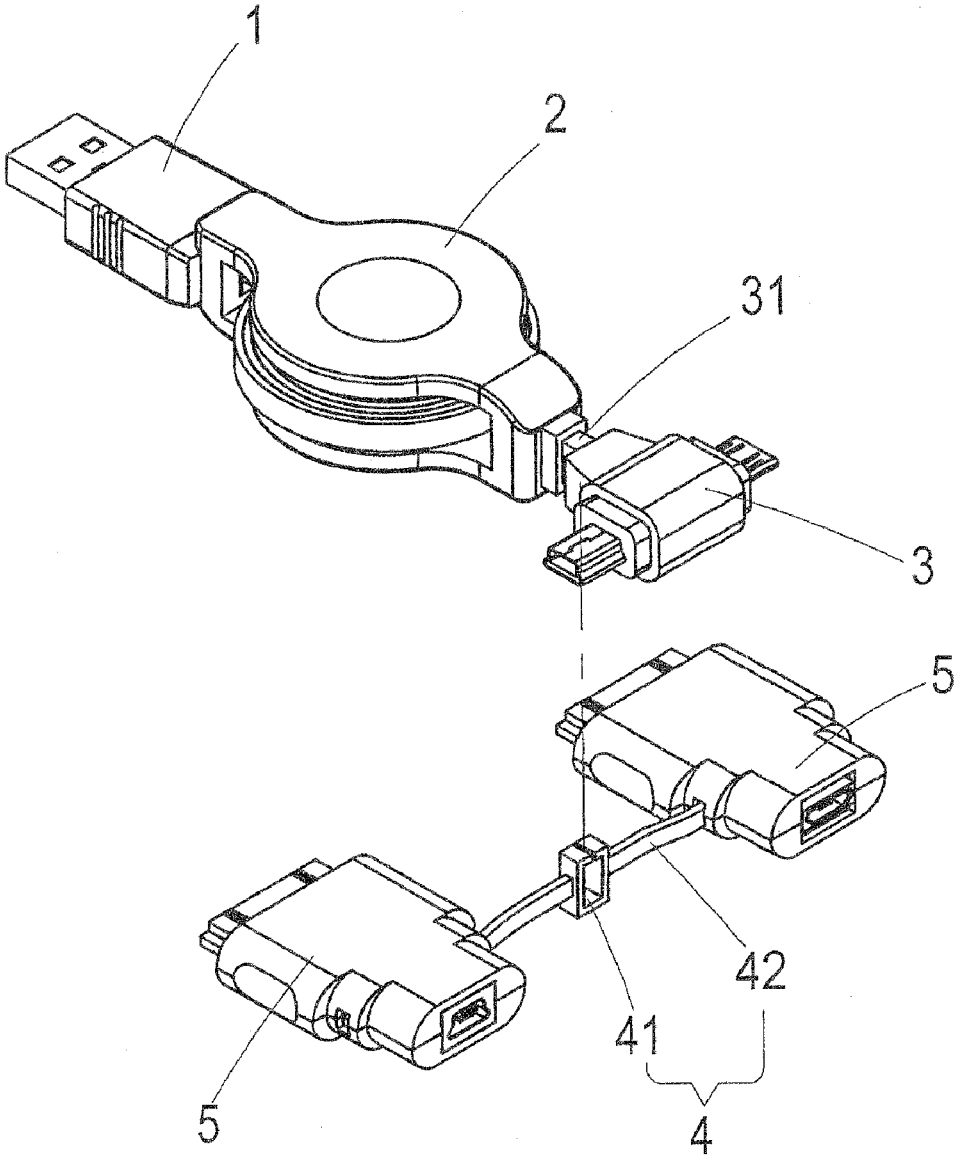
FIG. 3 is a schematic view of a combination relationship between the connecting kit and the tap connector of the present invention.

As shown in both FIGS. 2 and 3, each adapter 5 is formed by upper and lower shells. Attaching holes 51*a* and 51*b* are arranged at sides of the shells of the adapter 5 to be used for placing a convex end portion 43 of the connecting kit when the upper and lower shells are connected, so that the two adapters 5 are presented in a form where they are connected through two attaching segments. A spigot 41 is arranged between the two attaching segments 42 for matching with the tapping part.

Figure 4:
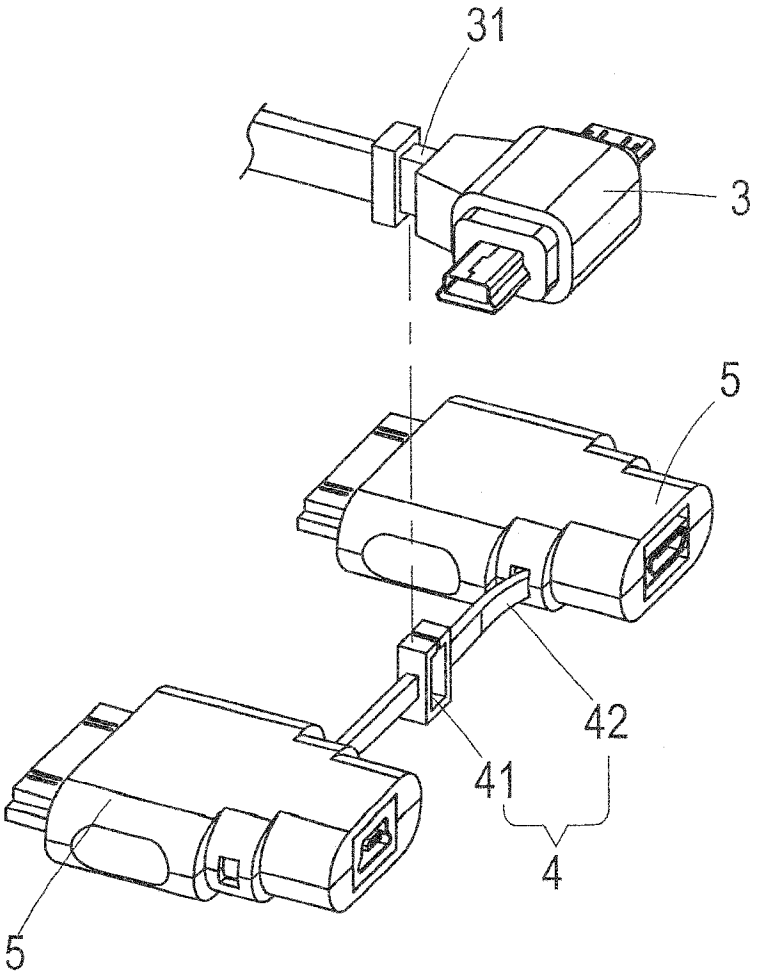
FIG. 4 is a schematic enlarged view of a combination part between the connecting kit and the tap connector of the present invention.

Refer to FIG. 4, which is a schematic enlarged view of a combination part between the connecting kit and the tap connector of the present invention. The spigot 41 of the connecting kit 4 is sleeved on a concave groove 31 of a tap connector 3, so that the tap connector 3 can be attached to the two adapters through the connecting kit 4, achieving an effect of losing no required adapter.

Figure 5:
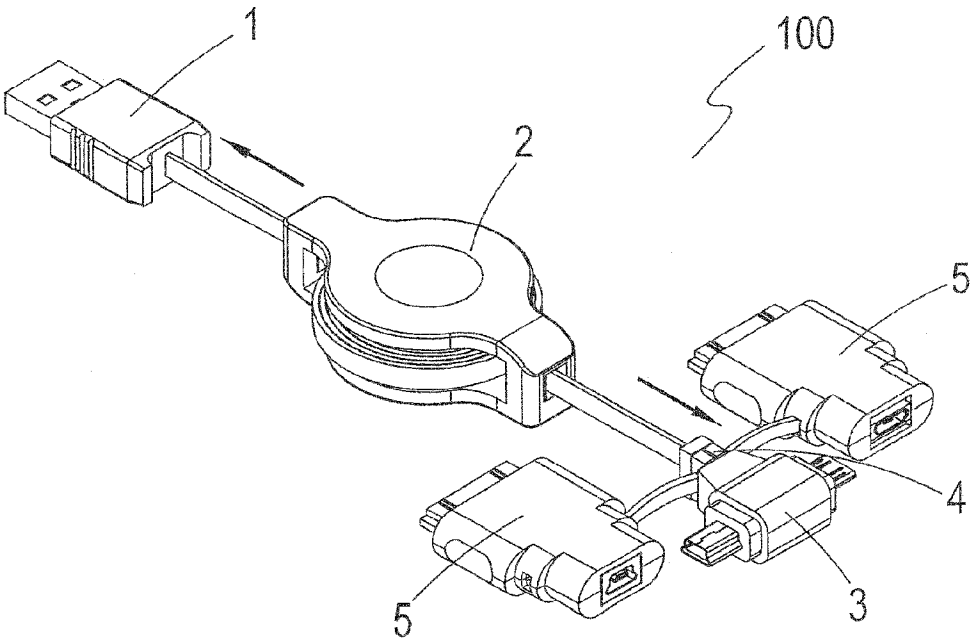
FIG. 5 is a schematic view of an embodiment of the present invention.

Refer to FIG. 5, which illustrates an embodiment of the present invention. The wiring part 2 is a double-pull winder with two outlet wires, which can be changed to a multi-functional adaptation device with a lengthening function when used with the multi-connector originality of the present invention.

Figure 6:
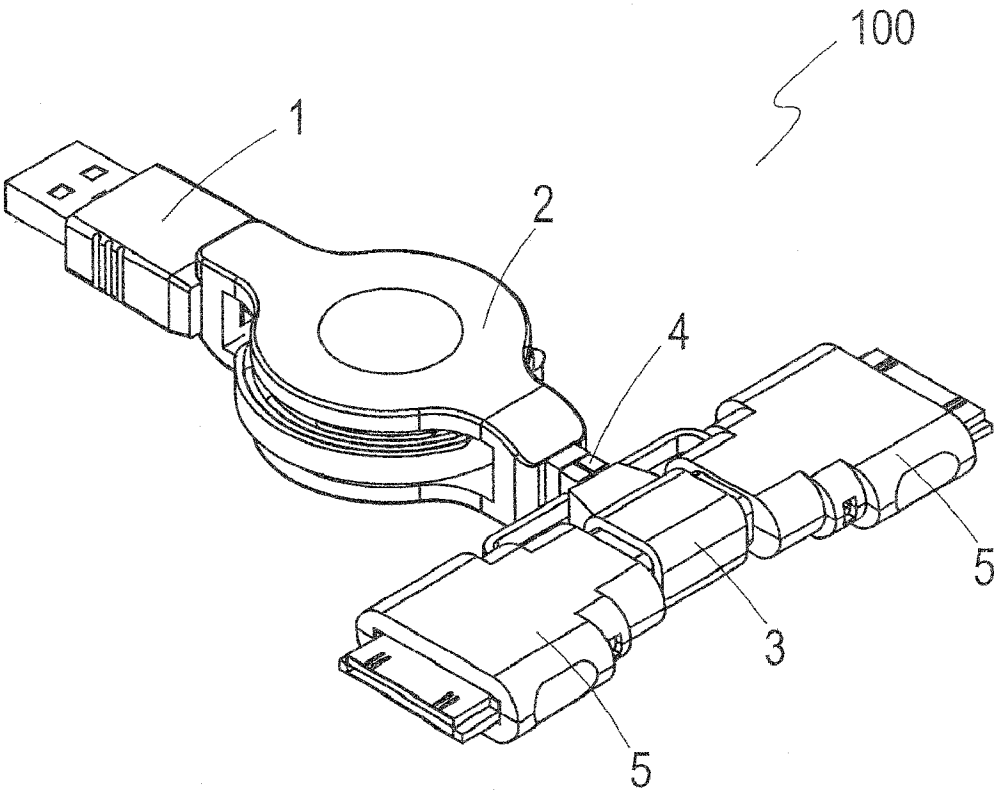
FIG. 6 is a first schematic view of another embodiment of the present invention.

Refer to FIG. 6, which illustrates another embodiment of the present invention. The adapter 5 is plugged into the tap connector 3, so that the transmission connector 1 can conveniently switch interfaces through the adapter 5.

Figure 7:
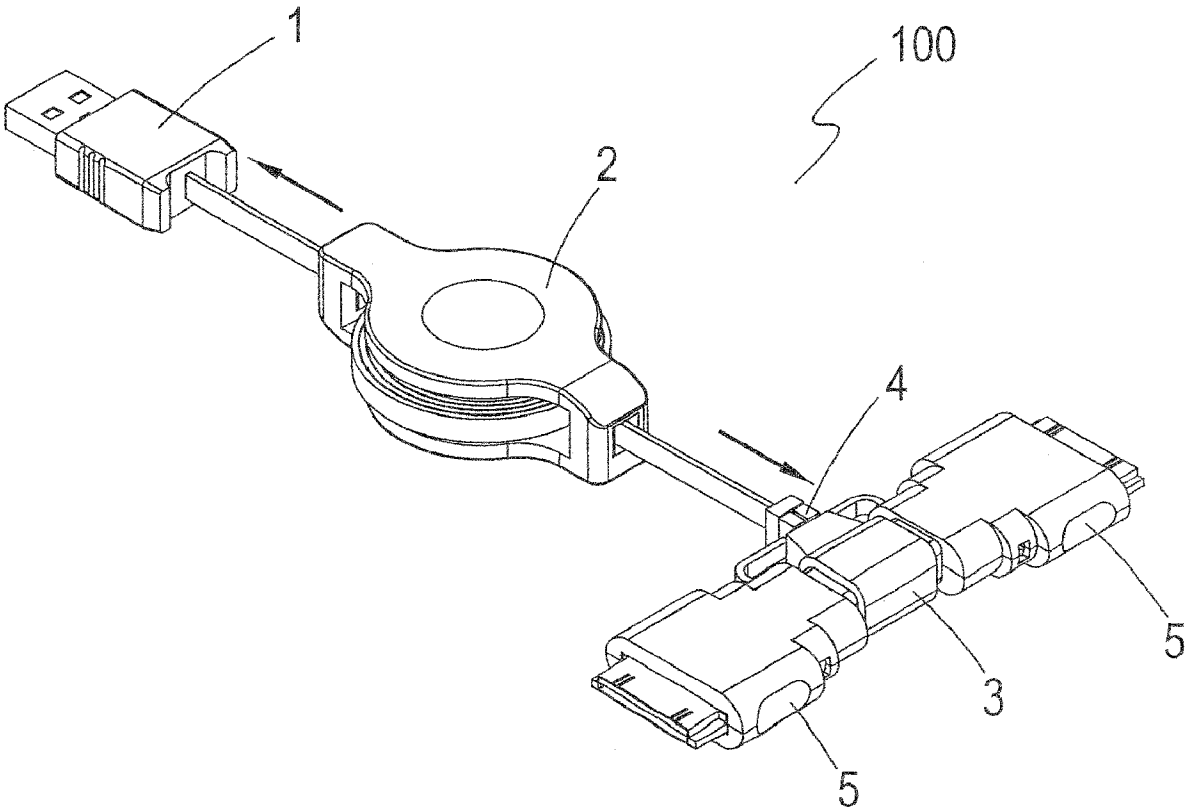
FIG. 7 is a second schematic view of another embodiment of the present invention.

Refer to FIG. 7, which illustrates a manner of another embodiment of the present invention for extending a using distance. The connector of the tapping part 3 is capable of being connected with a USB connector, a MINI USB connector, a MICRO USB connector, an HDMI connector and a tablet computer connector. Further, the connector of the adapter 5 is capable of being connected with a USB connector, a MINI USB connector, a MICRO USB connector, an HDMI connector and a tablet computer connector. Moreover, the material of the connecting kit is a rubber or flexible soft material.

I claim:

1. A multi-functional adaptation winder, comprising:

a wiring part;

a transmission connector connected with an outlet wire at one end of the wiring part;

a tapping part provided with at least one connector which is connected with an outlet wire at the other end of the wiring part;

at least one adapter connected with the connector of the tapping part, wherein the adapter is provided with at least one attaching hole at an external portion thereof;

a connecting kit provided with at least one attaching segment and a spigot, wherein the spigot is connected with the tapping part, and the attaching segment is matched with the attaching hole.

2. The multi-functional adaptation winder of claim 1, wherein the wiring part is a double-pull winder with bidirectional outlet wires.

3. The multi-functional adaptation winder of claim 1, wherein the transmission connector is a USB connector.

4. The multi-functional adaptation winder of claim 1, wherein the tapping part has two connectors.

5. The multi-functional adaptation winder of claim 1, wherein the connector of the tapping part is capable of being connected with a USB connector, a MINI USB connector, a MICRO USB connector, an HDMI connector and a tablet computer connector.

6. The multi-functional adaptation winder of claim 1, wherein the adapter is provided with at least two connectors with different interfaces, and the at least two connectors are connected electrically in the adapter.

7. The multi-functional adaptation winder of claim 1, wherein a connector of the adapter is capable of being connected with a USB connector, a MINI USB connector, a MICRO USB connector, an HDMI connector and a tablet computer connector.

8. The multi-functional adaptation winder of claim 1, wherein a material of the connecting kit is a rubber or flexible soft material.

* * * * *